US005630567A

United States Patent [19]

Molina

[11] Patent Number: 5,630,567

[45] Date of Patent: May 20, 1997

[54] MONUMENTAL WASTE BASKET

[76] Inventor: Alcides Molina, P.O. Box 780, Canovanas, Puerto Rico, 00729

[21] Appl. No.: 438,030

[22] Filed: May 8, 1995

[51] Int. Cl.[6] ..... A47F 5/12

[52] U.S. Cl. ..... 248/137

[58] Field of Search ..... 40/606, 567; 248/133, 248/137, 141, 907

[56] References Cited

U.S. PATENT DOCUMENTS

| | | | |
|---|---|---|---|
| 235,753 | 12/1880 | Draper | 248/137 |
| 1,227,323 | 5/1917 | Russell | 248/137 |
| 1,327,778 | 1/1920 | Reichman | 40/606 |
| 1,816,974 | 8/1931 | Kavanagh | 40/567 |
| 1,837,447 | 12/1931 | Kenny | 40/567 |
| 2,543,008 | 2/1951 | French | 40/567 X |
| 3,167,205 | 1/1965 | Smith | 248/133 |
| 3,235,214 | 2/1966 | Sprung | 40/606 |
| 3,515,285 | 6/1970 | Wilkes | 211/71 |
| 3,530,995 | 9/1970 | Tremper | 211/71 |
| 4,069,997 | 1/1978 | Weiss | 248/907 X |
| 4,084,701 | 4/1978 | White | 211/81 |
| 5,139,219 | 8/1992 | Navarro | 248/97 |

FOREIGN PATENT DOCUMENTS

| | | | |
|---|---|---|---|
| 9202919 | 2/1992 | WIPO | 40/606 |

*Primary Examiner*—Kenneth J. Dorner
*Assistant Examiner*—Jerry Redman
*Attorney, Agent, or Firm*—Richard L. Miller, P.E.

[57] ABSTRACT

A waste basket arrangement with display capabilities that includes a frame adaptable to a surface, a display board fixedly attached to the frame, a basket rotatively mounted to the frame, rotating apparatus for rotatively mounting the basket to the frame, and limiting apparatus for limiting the amount of rotation of the basket relative to the frame so that when the basket is rotated the basket is prevented from turning completely over and thus facilitates the dumping and jarring of trash from the basket.

12 Claims, 1 Drawing Sheet

FIG. 1
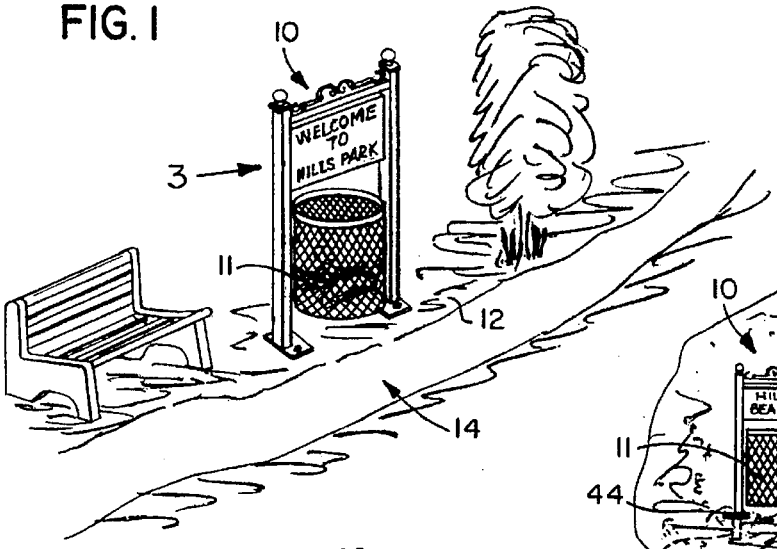
FIG. 2
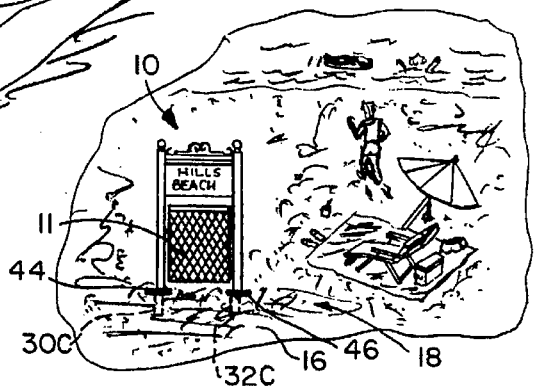
FIG. 3
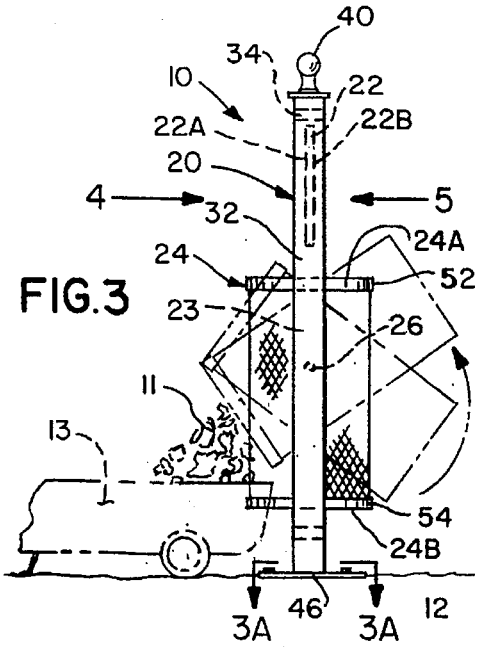
FIG. 4
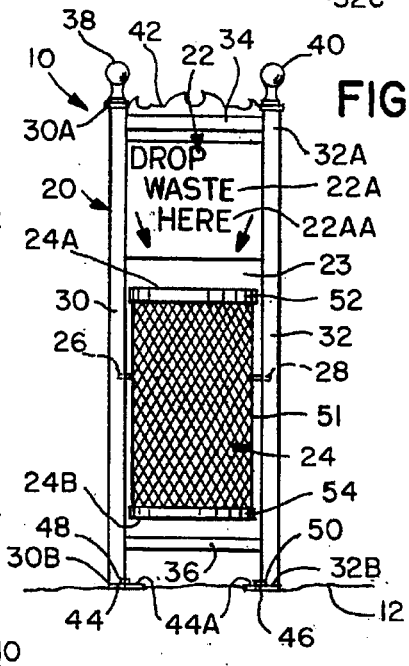
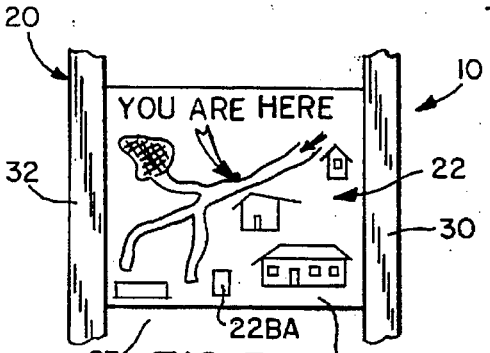
FIG. 5
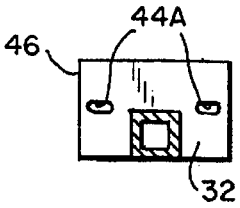
FIG. 3A

MONUMENTAL WASTE BASKET

BACKGROUND OF THE INVENTION

The present invention relates to a waste basket. More particularly, the present invention relates to a waste basket that is pivotally mounted to a frame and that includes a display board.

There is a need for providing means for preventing the overturning of garbage cans by stray animals, high winds and the like and for preventing the corrosion of such cans when in contact with the ground.

Numerous innovations for waste basket holders have been provided in the prior art that will be described. However, even though these innovations may be suitable for the specific individual purposes to which they address, they differ from the present invention in that they do not provide a waste basket with an ornamental display pack that has a pivoting mechanism which permits and facilitates the dumping of trash therefrom while simultaneously preventing the trash pail from being removed from the anchoring structure.

For example, U.S. Pat. No. 3,515,285 to Wilkes teaches a trash can holder that includes a central post containing a series of bolt holes. Near the bottom of the post is bolted two pair of feet containing notches to receive the bottom rim of the trash can and a cam surface to guide the rim into the notches. The cam is supported by its handle in one of two fingers bolted to the post. The tops of the cans are held by pivoted arms containing slots.

Another example, U.S. Pat. No. 3,530,995 to Tremper teaches a support for garbage cans that includes three vertical rods connected at their upper and lower ends by triangular connector plates at the corners of the plates. The upper connector plate has three upwardly extending tabs that form hooks. Each hook is positioned on one edge at the middle of one of the sides of the triangular plate and over which the handles of three garbage cans can be fitted independently and individually. The bases of the cans are positioned against the two rods between which their respective hooks are positioned equidistantly.

Still another example, U.S. Pat. No. 4,084,701 to White teaches a trash can securing device that includes a first pair of semi-cylindrical frame basket retainers hingedly affixed to a horizontal platform with a latch for securing them in a desired inclination. A linking device is mounted on the platform between and pivotally connected to the first pair of basket retainers. A second pair of semi-cylindrical frame basket retainers is also hingedly affixed to the horizontal platform. Spring are provided for coupling the first pair of basket retainers to the second pair of semi-cylindrical frame basket retainers.

Finally, an example, U.S. Pat. No. 5,139,219 to Navarro teaches a bag holder that includes a standard with a [pointed lower end and a foot peg for pushing the pointed end into the ground. An adjustable clamp assembly is movable mounted to the standard and has a lock for securing it to the standard at a desired position. An elongated flat spring strip is attached to the clamp assembly.

It is apparent that numerous innovations for waste basket holders have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide monumental waste basket that avoids the disadvantages of the prior art.

Another object of the present invention is to provide a monumental waste basket that is simple and inexpensive to manufacture.

Still another object of the present invention is to provide a monumental waste basket that is simple to use.

Yet another object of the present invention is to provide a monumental waste basket that can be used on beaches, in parks, inside and outside of public buildings, in car parking lots, on side walks, and in schools.

Still yet another object of the present invention is to provide a monumental waste basket that can not be stolen.

Yet still another object of the present invention is to provide a monumental waste basket that will not be blown away or toppled over by animals, winds, or the like.

Still yet another object of the present invention is to provide a monumental waste basket that has a dual purpose.

Yet still another object of the present invention is to provide a monumental waste basket wherein the dual purpose includes functioning as a waste basket and a signpost to display information.

Still yet another object of the present invention is to provide a monumental waste basket that includes a frame adaptable to a surface, a display board fixedly attached to the frame, a basket rotatively mounted to the frame,rotating apparatus for rotatively mounting the basket to the frame, and limiting apparatus for limiting the amount of rotation of the basket relative to the frame so that when the basket is rotated the basket is prevented from turning completely over and is automatically held in a dumping position by the limiting apparatus eliminating the need to manually hold the basket.

Yet still another object of the present invention is to provide a monumental waste basket wherein the frame is manufactured from 1/16" gauge square tubes.

Still yet another object of the present invention is to provide a monumental waste basket wherein the frame has a first upright member with a first upright member upper end and a first upright member lower end, a second upright member that is displaced a distance from the first member and has a second upright member upper end and a second upright member lower end, an upper crossmember that fixedly connects the first upright member to the second upright member in the proximity of the first upright member upper end and the second upright member upper end, and a lower crossmember that fixedly connects the first upright member to the second upright member in the proximity of the first upright member lower end and the second upright member lower end. Yet still another object of the present invention is to provide a monumental waste basket that further includes a first ball cap that is fixedly attached to the first upright member at the first upright member upper end, a second ball cap that is fixedly attached to the second upright member at the second upright member upper end, and an ornament that is fixedly attached to the upper crossmember so that aesthetic beauty is added.

Still yet another object of the present invention is to provide a monumental waste basket that further includes a first mounting plate that is fixedly attached to the first upright member at the first upright member lower end and contains a first mounting plate substantially oval-shaped aperture and a second mounting plate that is fixedly attached to the second upright member at the second upright member lower end and contains a second mounting plate substantially oval-shaped aperture.

Yet still another object of the present invention is to provide a monumental waste basket wherein the display board has a display board front face and a display board rear face and is connected to the first upright member and the second upright crossmember at a position intermediate the upper crossmember and the lower crossmember and provides additional structural support to the frame.

Still yet another object of the present invention is to provide a monumental waste basket that further includes front face printed matter that is disposed on the display front face and rear face printed matter disposed on the display rear face.

Yet still another object of the present invention is to provide a monumental waste basket wherein the basket is disposed intermediate the display board and the lower crossmember and has a basket cylindrical body with a basket open top and a basket closed bottom, a basket upper ring that is affixed to the basket body at the basket open top, and a basket lower ring that is affixed to the basket closed bottom so that the cylindrical shape of the basket cylindrical body is maintained.

Still yet another object of the present invention is to provide a monumental waste basket wherein the rotating apparatus includes a first pivot pin that is fixedly attached to the basket body and is pivotally received by the first upright member and a second pivot pin that is fixedly attached to the basket body and is pivotally received by the second upright member.

Yet still another object of the present invention is to provide a monumental waste basket wherein the basket upper ring and said basket lower ring are manufactured from ⅛" metal.

Still yet another object of the present invention is to provide a monumental waste basket wherein the first mounting plate and the second mounting plate are manufactured from ¼" gauge metal.

Finally, an another object of the present invention is to provide a monumental waste basket wherein the limiting apparatus includes the display board.

The novel features which are considered characteristic of the present invention are set forth in the appended claims. The invention itself, however, both as to its construction and method of operation, together with additional objects and advantages thereof, will be best understood from the following description of the specific embodiments when read and understood in connection with the accompanying drawing.

BRIEF DESCRIPTION OF THE DRAWING

FIG. 1 is a diagrammatic perspective view illustrating the instant invention installed in a park;

FIG. 2 is a diagrammatic perspective view illustrating the instant invention installed in a park;

FIG. 3 is an elevational view of the instant invention per se taken in the direction of arrow 3 in FIG. 1;

FIG. 3A is an enlarged cross sectional view taken on line 3A—3A in FIG. 3 with the fasteners removed and illustrating typical oval apertures in a typical mounting plate;

FIG. 4 is an elevational view taken in the direction of arrow 4 in FIG. 3; and FIG. 5 is an elevational view with parts broken away taken in the direction of arrow 5 in FIG. 3.

LIST OF REFERENCE NUMERALS UTILIZED IN THE DRAWING

10—monumental waste basket
11—waste
12—ground
13—truck
14—park
16—sand
18—beach
20—frame
22—display board
22A—front face
22AA—front face printed matter
22B—rear face
22BA—rear face printed matter
23—basket space
24—basket
24A—basket open top
24B—basket closed bottom
26—first pivot pin
28—second pivot pin
30—first upright member
30A—first upright member upper end
30B—first upright member lower end
30C—first upright member exposed portion
32—second upright member
32A—second upright member upper end
32B—second upright member lower end
32C—second upright member exposed portion
34—upper crossmember
36—lower crossmember
38—first ball cap
40—second ball cap
42—ornament
44—first mounting plate
44A—oval shaped aperture
46—second mounting plate
48—first fastener
50—second fastener
51—basket body
52—basket upper ring
54—basket lower ring

DETAILED DESCRIPTION OF THE PREFERRED EMBODIMENT

Referring now to the figures in which like numerals indicate like parts, and particularly to FIGS. 1 and 2, respectively, the monumental waste basket of the present invention is shown generally at 10, containing waste 11 and being fixedly attached to the ground 12 of a park 14 or in the alternative disposed in the sand 16 of a beach 18.

The configuration of the monumental waste basket 10 can best be seen in FIGS. 3 through 5, and as such, will be discussed with reference thereto.

The monumental waste basket 10 includes a frame 20, a display board 22 that is fixedly attached to the frame 20, and a basket 24 that is pivotally mounted to the frame 20 by a first pivot pin 26 and a second pivot pin 28.

The frame 20 can be manufactured typically from 1/16" gauge square tubes, but is not limited to that, and has a first upright member 30 with a first upright member upper end 30A and a first upright member lower end 30B, a second upright member 32 displaced a distance from the first upright member 30 and has a second upright member upper end 32A and a second upright member lower end 32B, an upper crossmember 34 fixedly connecting the first upright member 30 to the second upright member 32 at the first upright member upper end 30A and the second upright member upper end 32A, and an optional lower crossmember 36 fixedly connecting the first upright member 30 to the second upright member 32 in the proximity of the first upright member lower end 30B and the second upright member lower end 32A.

The presence of the optional lower crossmember 36 adds structural support to the frame 20. In the case of using metal components for the frame 20 welding can be used, but is not limited to that. And in the case of using wood components for the frame 20, mortise and tendon joinery can be used, but is not limited to that.

Fixedly attached to the first upright member 30 at the first upright member upper end 30A is a first ball cap 38 and fixedly attached to the second upright member 32 at the second upright member upper end 32A is a second ball cap 40. An ornament 42 is fixedly attached to the upper crossmember 34 and together with the first ball cap 38 and the second ball cap 40 provide aesthetic beauty to the monumental waste basket 10.

Fixedly attached to the first upright member 30 at the first upright member lower end 30B is a first mounting plate 44. The first mounting plate can be manufactured typically from ¼" gauge metal, but is not limited to that, and contains a first mounting plate substantially oval-shaped aperture 44A, as shown in FIG. 3A.

Fixedly attached to the second upright member 32 at the second upright member lower end 30B is a second mounting plate 46. The second mounting plate 46 can also be manufactured from ¼" gauge metal, but is not limited to that, and contains a second mounting plate substantially oval-shaped aperture 44A as shown in FIG. 3A.

The presence of the first mounting plate having substantially oval-shaped aperture 44A and the second mounting plate having substantially oval-shaped aperture 44A allow at least one first fastener 48 and at least one second fastener 50 to adjustably secure the monumental waste basket 10 to the ground 12 while compensating for the irregularities of the surface contours and the effects of temperature change, such as contraction and expansion.

When the monumental waste basket 10 is used on the beach 18 (see FIG. 2), the first mounting plate 44 can be attached to the first upright member 30 a distance upwardly from the first upright member lower end 30B so as to provide a first member exposed portion 30C. The second mounting plate 46 can be attached to the second upright member 32 a distance upwardly from the second upright member lower end 32B so as to provide a second member exposed portion 32C. The presence of the first member exposed portion 30C and the second member exposed portion 32C allows the frame 20 to be pressed in to the sand 16 and provide additional stability therefor.

The display board 22 has a display board front face 22A and a display board rear face 22B. The display board 22 is connected to the first upright member 30 and the second upright crossmember 32 at a position intermediate the upper crossmember 34 and the lower crossmember 36 while providing additional structural support to the frame 20. The first upright member 30, the second upright member 32, and the display board 22 define a basket space 23 in which the basket 24 is disposed.

Disposed on the display front face 22A is front face printed matter 22AA and disposed on the display rear face 22B is rear face printed matter 22BA. The front face printed matter 22AA and the rear face printed matter 22BA can be infirmation, such as, a map, a sign, a direction or the like, but is not limited to that. Also, the display board 22 can be a bulletin board on to which documents can be tacked.

The basket 24 has a basket cylindrical body 51 that can be manufactured typically from 13" gauge expanded metal, but is not limited to that, and has a basket open top 24A and a basket closed bottom 24B. A basket upper ring 52, can be manufactured typically from ⅛" metal, but is not limited to that, is affixed to the basket 24 at the basket open top 24A. A basket lower ring 54, can be manufactured typically from ⅛" metal, but is not limited to that, is affixed to the basket closed bottom 24B. The presence of the upper ring 52 and the lower ring 54 maintains the cylindrical shape of the body 51 while assuring the integrity of the basket open top 24A and the basket closed bottom 24B. The basket 24 is disposed intermediate the display board 22 and the lower crossmember 36.

The first pivot pin 26 is fixedly attached to the basket body 51 and is pivotally received by the first upright member 30 while the second pivot pin 28 is also fixedly attached to the basket body 51 and is pivotally received by the second upright member 32. The second pivot pin 28 is in alignment with the first pivot pin 26 forming a pivoting axis for the basket 24.

The operation of the monumental waste basket 10 can best be seen in FIG. 3, and as such, will be discussed with reference thereto.

The basket 24 is so positioned within the basket space 23 so that the distance from the first pivot pin 26 and the second pivot pin 28 to the basket closed bottom 24B is greater than the distance from the first pivot pin and the second pivot pin 28 to the display board 22. With this positioning, the basket 24 is prevented from turning completely upside down or spinning when the waste 11 is dumped into a truck 13. This arrangement facilitates manually holding the basket in a dumping position because it prevents one from inadvertently tipping the basket to far. In addition if trash is stuck in the basket this allows an impact to be imparted to the basket by banging it against display board 22 to help jar or dislodge trash 11 therefrom.

It will be understood that each of the elements described above, two or more together, may also find a useful application in other typed of constructions differing from the typed described above.

While the invention has been illustrated and described as embodied in a monumental waste basket, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed as new and desired to be protected by Letters Patent is set forth in the appended claims.

The invention claimed is:

1. A waste basket uprightably mountable to a generally horizontal surface at a location in a park and compensating for irregularities in contour of the generally horizontal surface at the location in the park and compensating for expansion and contraction caused by changes in temperature while providing a visual display of the location of said waste basket in the park for a viewer to observe so as to allow the viewer to know the location the viewer is at in the park and being normally upright and prevented from turning completely upside down and spinning when waste is being evacuated therefrom while eliminating the waste from sticking therein by jarring and dislodging the waste therefrom, comprising:

a) a frame having:

i) a first elongated, slender, and vertically-oriented column with an upper end and a lower end;

ii) a second elongated, slender, and vertically-oriented column being horizontally spaced from, and parallel to, said first elongated, slender, and vertically-oriented column of said frame and having an upper end and a lower end;

iii) an elongated, slender, and horizontally-oriented upper cross member extending perpendicularly from said upper end of said first elongated, slender, and vertically-oriented column of said frame perpendicularly to said upper end of said second elongated, slender, and vertically-oriented column of said frame;

iv) an elongated, slender, and horizontally-oriented lower cross member disposed below, and parallel to, said elongated, slender, and horizontally-oriented upper cross member of said frame and extending perpendicularly from slightly above said lower end of said first elongated, slender, and vertically-oriented column of said frame perpendicularly to slightly above said lower end of said second elongated, slender, and vertically-oriented column of said frame;

v) a first flat, thin, rectangular-shaped, and horizontally-oriented mounting plate fixedly attached perpendicularly to said lower end of said first elongated, slender, and vertically-oriented column of said frame and being abutable against the generally horizontal surface at the location in the park and having a pair of oval-shaped throughbores extending vertically therethrough each of which being on opposite sides of said first elongated, slender, and vertically-oriented column of said frame and receiving for lateral movement therein fasteners for mounting said waste basket to the generally horizontal surface at the location in the park, so that irregularities in the contour of the generally horizontal surface at the location in the park and expansion and contraction caused by changes in temperature are compensated for by the lateral movement of the fasteners in said pair of oval-shaped throughbores in said first flat, thin, rectangular-shaped, and horizontally-oriented mounting plate; and vi) a second flat, thin, rectangular-shaped, and horizontally-oriented mounting plate fixedly attached perpendicularly to said lower end of said second elongated, slender, and vertically-oriented column of said frame and being abutable against the generally horizontal surface at the location in the park and having a pair of oval-shaped throughbores extending vertically therethrough each of which being on opposite sides of said second elongated, slender, and vertically-oriented column of said frame and receiving for lateral movement therein fasteners for mounting said waste basket to the generally horizontal surface at the location in the park, so that irregularities in the contour of the generally horizontal surface at the location in the park and expansion and contraction caused by changes in temperature are compensated for by the lateral movement of the fasteners in said pair of oval-shaped throughbores in said second flat, thin, rectangular-shaped, and horizontally-oriented mounting plate;

b) a rectangular-shaped display board extending perpendicularly from, and being fixedly attached to, said first elongated, slender, and vertically-oriented column of said frame perpendicularly to, and being fixedly attached to, said second elongated, slender, and vertically-oriented column of said frame and slightly below said elongated, slender, and horizontally-oriented upper cross member of said frame and having a front face with a map having an arrow and "YOU ARE HERE" indica thereon with said arrow of said map on said front face of said rectangular-shaped display board pointing on said map on said front face of said rectangular-shaped display board to the location in the park of said waste basket, so that a visual display of the location of said waste basket in the park is provided for the viewer to observe so as to allow the viewer to know the location the viewer is at in the park;

c) a cylindrically-shaped basket being pivotally mounted to said first elongated, slender, and vertically-oriented column of said frame and said second elongated, slender, and vertically-oriented column of said frame and between said rectangular-shaped display board and said elongated, slender, and horizontally-oriented lower cross member of said frame and having a closed bottom, a cylindrically-shaped outer surface, a center of gravity, and an open top for receiving the waste; and d) pivoting means for pivotally mounting said cylindrically-shaped basket to said first elongated, slender, and vertically-oriented column of said frame and said second elongated, slender, and vertically-oriented column of said frame and including a first horizontally-oriented pivot pin extending normally outwardly from said cylindrically-shaped outer surface of said cylindrically-shaped basket to said first elongated, slender, and vertically-oriented column of said frame and a second horizontally-oriented pivot pin extending normally outwardly from said cylindrically-shaped outer surface of said cylindrically-shaped basket to said second elongated, slender, and vertically-oriented column of said frame in an opposite direction to, and in horizontal alignment with, said first horizontally-oriented pivot pin of said pivoting means; said first horizontally-oriented pivot pin of said pivoting means and said second horizontally-oriented pivot pin of said pivoting means disposed closer to said open top of said cylindrically-shaped basket than to said closed bottom of said cylindrically-shaped basket so as to cause said center of gravity of said cylindrically-shaped basket to be below said first horizontally-oriented pivot pin of said pivoting means and said second horizontally-oriented pivot pin of said pivoting means, so that said cylindrically-shaped basket is normally upright; said first horizontally-oriented pivot pin of said pivoting means and said second horizontally-oriented pivot pin of said pivoting means disposed a distance from said closed bottom of said cylindrically-shaped basket so as to allow said closed bottom of said cylindrically-shaped basket to abut against, and be stopped by, said rectangular-shaped display board when said cylindrically-shaped basket is pivoted and the waste is being evacuated therefrom, so that said cylindrically-shaped basket is prevented from turning completely upside down and spinning when the waste is being evacuated therefrom while eliminating the waste from sticking therein by banging said cylindrically-shaped basket against said rectangular-shaped display board so as to jar and dislodge the waste therefrom.

2. The basket as defined in claim 1, wherein said first elongated, slender, and vertically-oriented column of said frame, said second elongated, slender, and vertically-oriented column of said frame, said elongated, slender, and horizontally-oriented upper cross member of said frame, and said elongated, slender, and horizontally-oriented lower cross member of said frame are manufactured from 1/16" gauge square tubes.

3. The basket as defined in claim 1; further comprising a first ball cap fixedly attached to said upper end of said first elongated, slender, and vertically-oriented column of said frame, a second ball cap fixedly attached to said upper end of said second elongated, slender, and vertically-oriented column of said frame, and an ornament fixedly attached to said elongated, slender, and horizontally-oriented upper cross member of said frame, so that aesthetic beauty is added.

4. The basket as defined in claim 1, wherein said open top of said cylindrically-shaped basket has fixedly attached therearound a top ring and said closed bottom of said cylindrically-shaped basket has fixedly attached therearound a bottom ring, so that said cylindrically-shaped basket is maintained in its cylindrical shape.

5. The basket as defined in claim 4, wherein said top ring of said cylindrically-shaped basket and said bottom ring of said cylindrically-shaped basket are manufactured from 1/8" metal.

6. The basket as defined in claim 1, wherein said first flat, thin, rectangular-shaped, and horizontally-oriented mounting plate of said frame and said second flat, thin, rectangular-shaped, and horizontally-oriented mounting plate are manufactured from 1/4" gauge metal.

7. A waste basket uprightably insertable in sand at a location on a beach and providing a visual display of the location of said waste basket on the beach for a viewer to observe so as to allow the viewer to know the location the viewer is at on the beach and being normally upright and prevented from turning completely upside down and spinning when waste is being evacuated therefrom while eliminating the waste from sticking therein by jarring and dislodging the waste therefrom, comprising:

a) a frame having:

i) a first elongated, slender, and vertically-oriented column with an upper end and a lower end;

ii) a second elongated, slender, and vertically-oriented column being horizontally spaced from, and parallel to, said first elongated, slender, and vertically-oriented column of said frame and having an upper end and a lower end;

iii) an elongated, slender, and horizontally-oriented upper cross member extending perpendicularly from said upper end of said first elongated, slender, and vertically-oriented column of said frame perpendicularly to said upper end of said second elongated, slender, and vertically-oriented column of said frame;

iv) an elongated, slender, and horizontally-oriented lower cross member disposed below, and parallel to, said elongated, slender, and horizontally-oriented upper cross member of said frame and extending perpendicularly from slightly above said lower end of said first elongated, slender, and vertically-oriented column of said frame perpendicularly to slightly above said lower end of said second elongated, slender, and vertically-oriented column of said frame;

v) a first flat, thin, rectangular-shaped, and horizontally-oriented mounting plate fixedly attached perpendicularly to said first elongated, slender, and vertically-oriented column of said frame a distance upwardly from said lower end of said first elongated, slender, and vertically-oriented column of said frame with said lower end of said first elongated, slender, and vertically-oriented column of said frame being a free end, so that said lower end of said first elongated, slender, and vertically-oriented column of said frame is inserted in the sand at the location on the beach and said first flat, thin, rectangular-shaped, and horizontally-oriented mounting plate of said frame rests against the sand at the location on the beach; and vi) a second flat, thin, rectangular-shaped, and horizontally-oriented mounting plate fixedly attached perpendicularly to said second elongated, slender, and vertically-oriented column of said frame a distance upwardly from said lower end of said second elongated, slender, and vertically-oriented column of said frame with said lower end of said second elongated, slender, and vertically-oriented column of said frame being a free end, so that said lower end of said second elongated, slender, and vertically-oriented column of said frame is inserted in the sand at the location on the beach and said second flat, thin, rectangular-shaped, and horizontally-oriented mounting plate of said frame rests against the sand at the location on the beach; and b) a rectangular-shaped display board extending perpendicularly from, and being fixedly attached to, said first elongated, slender, and vertically-oriented column of said frame perpendicularly to, and being fixedly attached to, said second elongated, slender, and vertically-oriented column of said frame and slightly below said elongated, slender, and horizontally-oriented upper cross member of said frame and having a front face with a map having an arrow and "YOU ARE HERE" indica thereon with said arrow of said map on said front face of said rectangular-shaped display board pointing on said map on said front face of said rectangular-shaped display board to the location on the beach of said waste basket, so that a visual display of the location of said waste basket on the beach is provided for the viewer to observe so as to allow the viewer to know the location the viewer is at on the beach;

c) a cylindrically-shaped basket being pivotally mounted to said first elongated, slender, and vertically-oriented column of said frame and said second elongated, slender, and vertically-oriented column of said frame and between said elongated, slender, and horizontally-oriented upper cross member of said frame and said elongated, slender, and horizontally-oriented lower cross member of said frame and having a closed bottom, a cylindrically-shaped outer surface, a center of gravity, and an open top for receiving the waste; and d) pivoting means for pivotally mounting said cylindrically-shaped basket to said first elongated, slender, and vertically-oriented column of said frame and said second elongated, slender, and vertically-oriented column of said frame and including a first horizontally-oriented pivot pin extending normally outwardly from said cylindrically-shaped outer surface of said cylindrically-shaped basket to said first elongated, slender, and vertically-oriented column of said frame and a second horizontally-oriented pivot pin extending normally outwardly from said cylindrically-shaped outer surface of said cylindrically-shaped basket to said second elongated, slender, and vertically-oriented column of said frame in an opposite direction to, and in horizontal alignment with, said first horizontally-oriented pivot pin of said pivoting means; said first horizontally-oriented pivot pin of said pivoting means and said second horizontally-oriented pivot pin of said pivoting means disposed closer to said open top of said cylindrically-shaped basket than to said closed bottom of said cylindrically-shaped basket so as to cause said center of gravity of said cylindrically-shaped basket to be below said first horizontally-oriented pivot pin of said pivoting means and said second horizontally-oriented pivot pin of said pivoting means, so that said cylindrically-shaped basket is normally upright; said first horizontally-oriented pivot pin of said pivoting means and said second horizontally-oriented pivot pin of said pivoting means disposed a distance from said closed bottom of said cylindrically-shaped basket so as to allow said closed bottom of said cylindrically-shaped basket to abut against, and be stopped by, said rectangular-shaped display board when said cylindrically-shaped basket is pivoted and the waste is being evacuated therefrom, so that said cylindrically-shaped basket is prevented from turning completely upside down and spinning when the waste is being evacuated therefrom while eliminating the waste from sticking therein by banging said cylindrically-shaped basket against said rectangular-shaped display board so as to jar and dislodge the waste therefrom.

8. The basket as defined in claim 7 wherein said first elongated, slender, and vertically-oriented column of said frame, said second elongated, slender, and vertically-oriented column of said frame, said elongated, slender, and horizontally-oriented upper cross member of said frame, and said elongated, slender, and horizontally-oriented lower cross member of said frame are manufactured from 1/16" gauge square tubes.

9. The basket as defined in claim 7; further comprising a first ball cap fixedly attached to said upper end of said first elongated, slender, and vertically-oriented column of said frame, a second ball cap fixedly attached to said upper end of said second elongated, slender, and vertically-oriented column of said frame, and an ornament fixedly attached to said elongated, slender, and horizontally-oriented upper cross member of said frame, so that aesthetic beauty is added.

10. The basket as defined in claim 7, wherein said open top of said cylindrically-shaped basket has fixedly attached therearound a top ring and said closed bottom of said cylindrically-shaped basket has fixedly attached therearound a bottom ring, so that said cylindrically-shaped basket is maintained in its cylindrical shape.

11. The basket as defined in claim 10, wherein said top ring of said cylindrically-shaped basket and said bottom ring of said cylindrically-shaped basket are manufactured from 1/8" metal.

12. The basket as defined in claim 7, wherein said first flat, thin, rectangular-shaped, and horizontally-oriented mounting plate of said frame and said second flat, thin, rectangular-shaped, and horizontally-oriented mounting plate are manufactured from 1/4" gauge metal.

* * * * *